US005423299A

United States Patent [19]

Kumagai

[11] Patent Number: 5,423,299

[45] Date of Patent: Jun. 13, 1995

[54] CONTROL VALVE OPENING CONTROL APPARATUS

[75] Inventor: Masato Kumagai, Atsugi, Japan

[73] Assignee: Unisia Jecs Corporation, Atsugi, Japan

[21] Appl. No.: 107,739

[22] PCT Filed: Jan. 8, 1993

[86] PCT No.: PCT/JP93/00020

§ 371 Date: Aug. 25, 1993

§ 102(e) Date: Aug. 25, 1993

[87] PCT Pub. No.: WO93/14309

PCT Pub. Date: Jul. 22, 1993

[30] Foreign Application Priority Data

Jan. 8, 1992 [JP] Japan ..... 4-001520
Nov. 11, 1992 [JP] Japan ..... 4-301349

[51] Int. Cl.[6] ..... F02D 9/00
[52] U.S. Cl. ..... 123/399; 123/400; 123/403
[58] Field of Search ..... 123/399, 400, 403

[56] References Cited

FOREIGN PATENT DOCUMENTS 2-286838 11/1990 Japan .
2-286839 11/1990 Japan .
3-61654 3/1991 Japan .

*Primary Examiner*—Noah P. Kamen
*Attorney, Agent, or Firm*—Foley & Lardner

[57] ABSTRACT

A control valve control apparatus includes a pivotally mounted accelerator lever linked to an accelerator operation and having a first engagement member, a drive lever linked to an actuator and having a second engagement member, a pivotally mounted control valve shaft lever assembled integral with a control valve and having a third engagement member, and a link lever for linking together the beforementioned levers. When the actuator 41 is not operated, the link lever 51 turns the control valve shaft 3 by means of the third engagement member 7 and the first engagement member 27 linked to accelerator operation. When the accelerator operation is fixed with the actuator operated, the link lever turns the control valve shaft 3 by means of the third engagement member 7 and the second engagement member 47 linked to the actuator 41. This arrangement provides a control valve control apparatus having few components and low cost.

12 Claims, 8 Drawing Sheets

CONTROL VALVE OPENING CONTROL APPARATUS

TECHNICAL FIELD

The invention relates to a control valve control apparatus for controlling a flow rate control valve such as a throttle valve and the like used in an automotive engine fuel supply system, when the valve is also driven by a device such as a step motor.

BACKGROUND ART

Control apparatus for preventing slip of a vehicle on ice bound or snow covered roads incorporate a traction controller to control the closing of a second throttle valve which is not linked to the accelerator pedal, thereby controlling the fuel flow rate to reduce engine torque and drive force.

Preferably, the traction controller should be small and light weight, however, with the above apparatus wherein the traction controller is arranged separate from and connected in series with the throttle valve, the size is increased.

There is a throttle valve control apparatus which utilizes a single control valve with the opening determined by operation of the accelerator pedal under normal conditions, and automatically controlled irrespective of accelerator pedal operation, under traction control conditions. (For example refer to Unexamined Japanese Patent Publication No. 3-61654).

With this type of apparatus, the throttle shaft incorporating a butterfly type throttle valve is turned either by the operation of the accelerator pedal through a lost motion mechanism, or by a linkage to an actuator drive system.

This construction for the control valve control apparatus for controlling a control valve such as a throttle valve, however, results in an increase in cost due to the increased number of components and increased complexity of the mechanism. Moreover, the large number of components makes intercomponent adjustment during assembly difficult, so that apparatus reliability is compromised.

It is, therefore, an object of the present invention to provide a control valve control apparatus which addresses the above situation by having fewer components, thereby reducing cost and improving reliability.

DISCLOSURE OF THE INVENTION

In view of the above, the control valve control apparatus according to the present invention comprises; a pivotally mounted accelerator lever linked to an accelerator operation and having a first engagement member disposed thereon at a distance from a pivotal axis of its pivotal mount, a drive lever linked to an actuator and having a second engagement member, a pivotally mounted control valve shaft lever formed integral with a control valve and having a third engagement member disposed thereon at a distance from a pivotal axis of its pivotal mount, and a link lever having engagement portions for engagement with said first, second and third engagement members such that at least two of said engagement members allow relative movement, for linking together said accelerator lever, drive lever and control valve shaft lever.

With such an arrangement for the present invention, operation of the accelerator pedal turns the accelerator lever accordingly, while operation of the actuator moves the drive lever linked thereto. Here, the accelerator lever, drive lever and control valve shaft lever are linked together by engagement of the engagement portions of the link lever with the first, second and third engagement members provided respectively on the accelerator lever, drive lever and control valve shaft lever, with at least two engagement members allowing relative movement.

Moreover, with the present invention, the construction is such that when the actuator is stationary, the link lever is pivoted about the second engagement member by the first engagement member, which is pivoted together with the accelerator lever by the accelerator operation, thereby turning the control valve by way of the third engagement member. Hence, when the actuator is stationary, the link lever pivots about the second engagement member to turn the control valve in accordance with the operation of the accelerator.

Furthermore, with the present invention, when the actuator is operated with the accelerator operation fixed, the link lever is pivoted about the first engagement member by the second engagement member linked to the actuator, thereby turning the control valve by way of the third engagement member. Hence, when the accelerator is not operated, the link lever pivots about the first engagement member with movement of the actuator to turn the control valve in accordance with the movement of the actuator.

In addition, a construction is possible wherein a regulator means for regulating the control valve opening below a predetermined opening, and ensuring a minimum control valve opening under accelerator operation, is attached to the drive lever. With provision of such a regulator, since this regulates the control valve opening below a pre-determined opening, the control valve can be opened/closed within a pre-determined range under accelerator operation, and also the minimum limit of control valve opening under accelerator operation maintained, thereby ensuring a "limp home" function.

The first, second and third engagement members may comprise respective first, second and third engagement pins respectively disposed on the accelerator lever, drive lever, and control valve shaft lever. Moreover, at least two of the engagement portions provided on the link lever may comprise elongated holes for engaging with at least two of the first, second or third engaging members.

The engagement portions which engage the first, second and third engagement members in that order with the link lever may be provided on the link lever.

Moreover, the pivotal axis of the accelerator lever and the axis of the control valve shaft assembled integral with the control valve may be located on the same axis.

A spring may be interposed between the link lever and the accelerator lever so as to urge the link lever in a constant direction relative to the accelerator lever.

Furthermore, a step motor may be used as an actuator with the drive lever having an axis parallel to the beforementioned pivotal axis such that when the step motor turns, the link lever is pivoted about the first engagement member by pivotal rotation of the drive lever, thereby turning the control valve by way of the third engagement member.

Moreover, a linear actuator having a direction of operation approximately perpendicular to the beforementioned pivotal axis may be used as an actuator such that when the linear actuator is operated, the link lever is pivoted about the first engagement member due to movement of the drive lever thereby turning the control valve by way of the third engagement member.

In addition, the regulator may comprise an adjustment screw which regulates the linkage of the drive lever from the actuator.

Furthermore, the control valve control apparatus according to the present invention may be used in an apparatus wherein a control amount is changed by variation of the control valve opening.

BEST MODE FOR CARRYING OUT THE INVENTION

Figure 1:
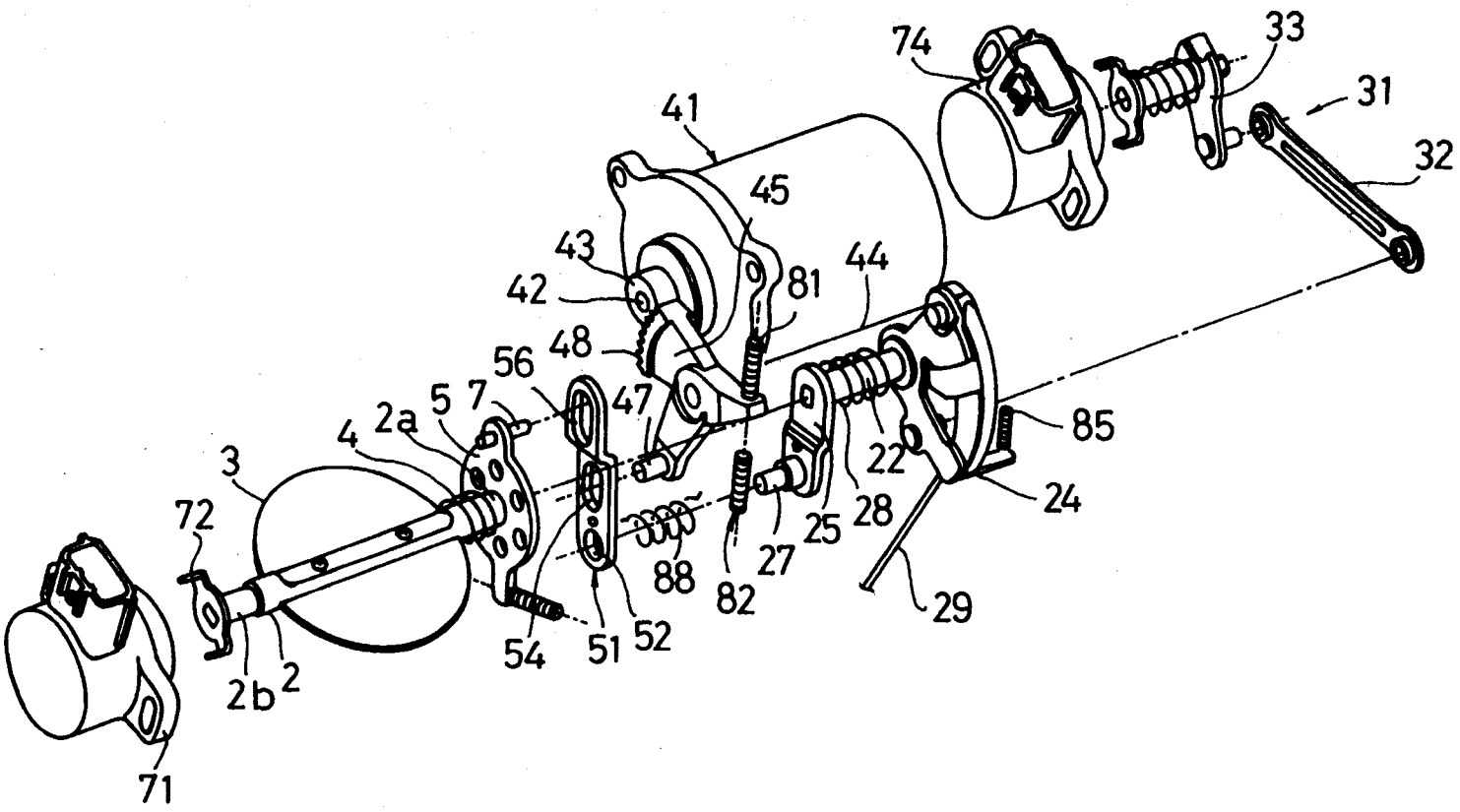
FIG. 1 is a schematic perspective view of a throttle valve control apparatus according to a first embodiment of the present invention.
Figure 2:
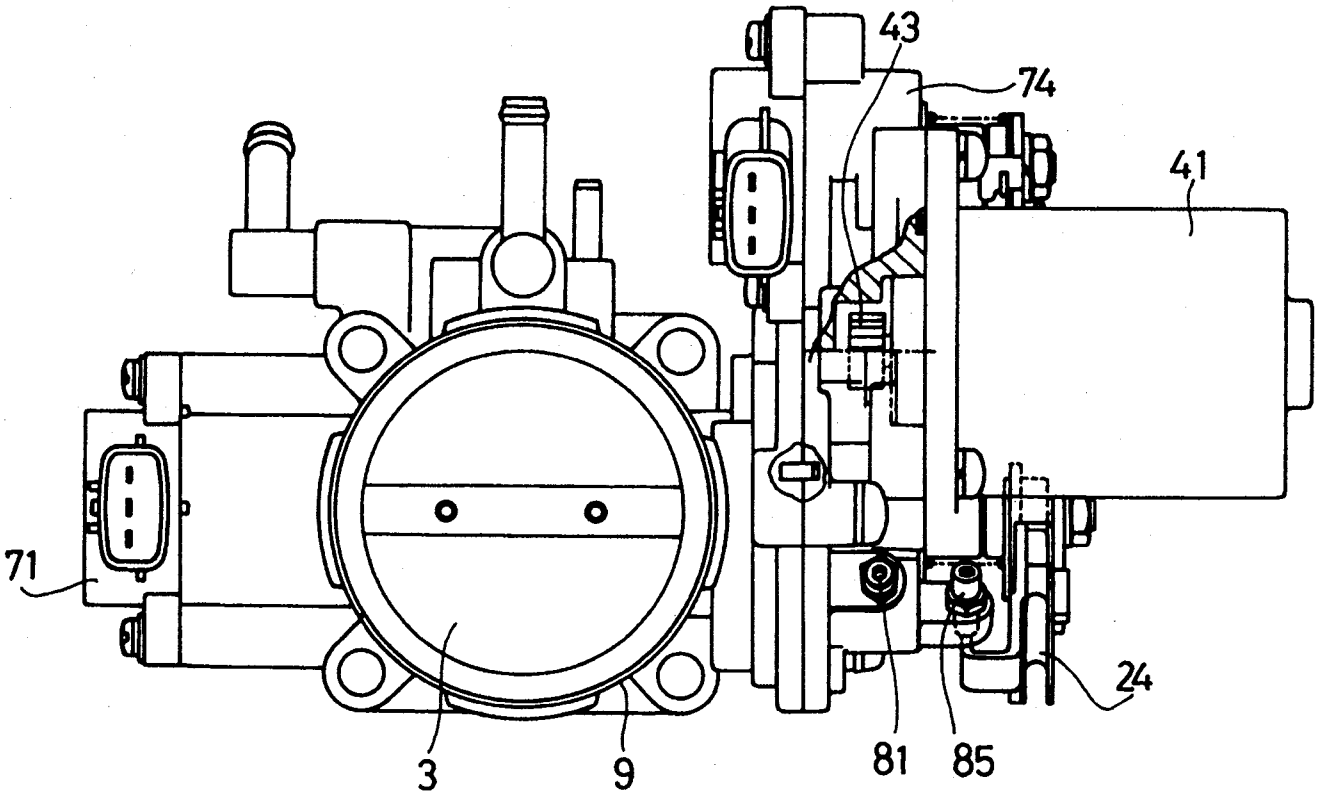
FIG. 2 is a plan view of the first embodiment.
Figure 3:
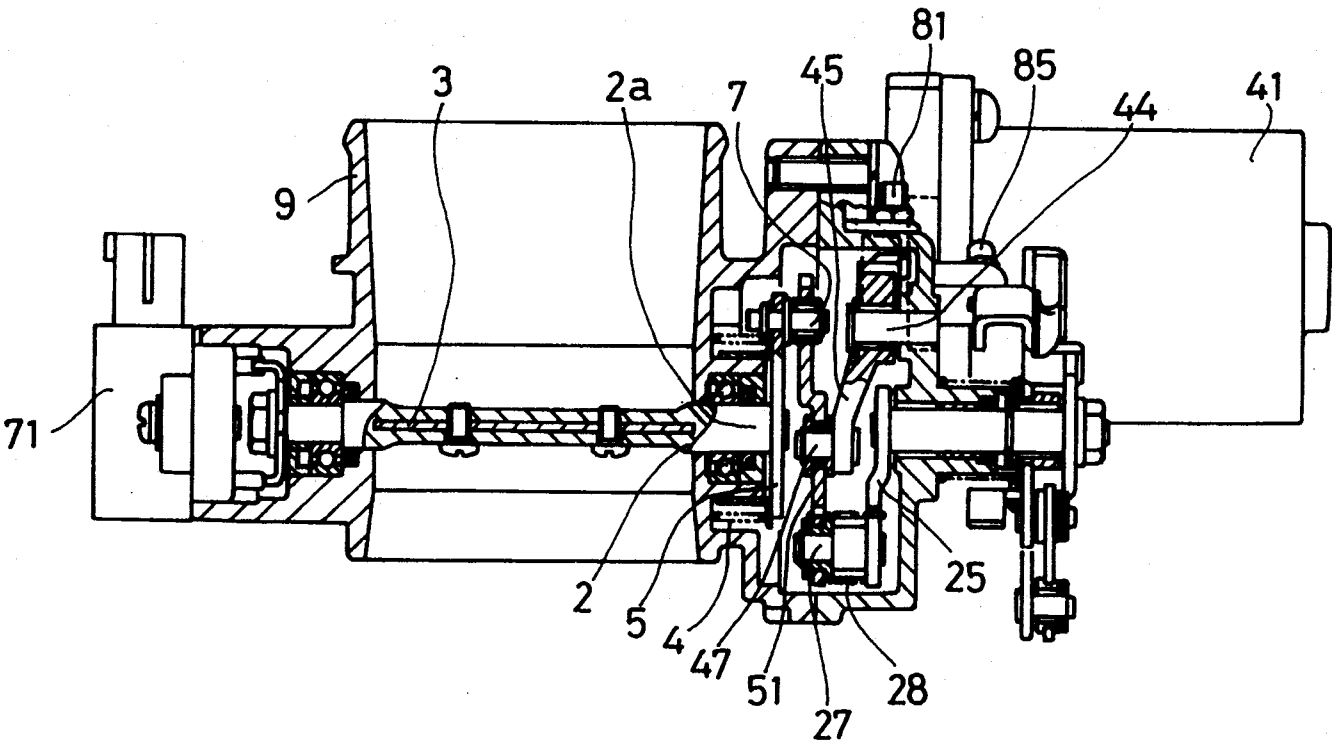
FIG. 3 is a sectional side view showing the principal components of the first embodiment.
Figure 4:
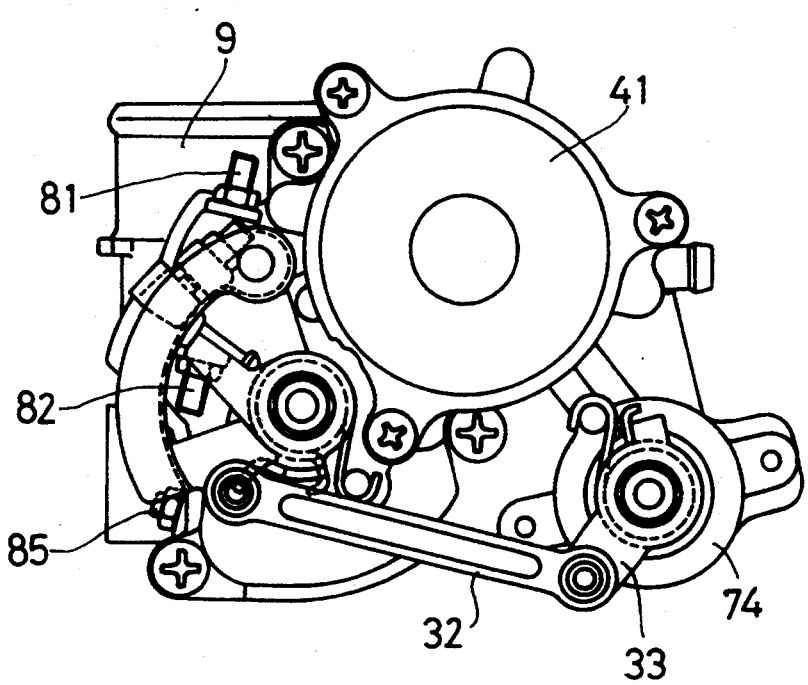
FIG. 4 is an end view of the first embodiment.

A more detailed description of the present invention is given below with reference to the accompanying drawings.

The Figures show a control apparatus according to the present invention applied to the control of a butterfly type throttle valve used as a control valve in a vehicle throttle control apparatus.

FIGS. 1 to 4 and FIGS. 5 to 11 show a first embodiment wherein a throttle shaft 2, to which is fixedly attached a butterfly type throttle valve 3, is supported so as to be freely rotatable on a support member such as a throttle body 9, and is urged in a direction to close the throttle valve 3 by means of a spring 4. A control valve shaft lever 5 is fixedly attached to a right end portion *2a* (right end in FIG. 1) of the throttle shaft 2. A third engagement pin 7 is provided on the control valve shaft lever 5 so as to protrude therefrom at a distance from and be pivotal about the throttle shaft 2.

A throttle opening detector 71 (opening detector) is fixedly supported on the throttle body 9 (or the like) near a left end *2b* of the throttle shaft 2 so as to face the left end *2b* of the throttle shaft 2, and is linked to a lever 72 fixed to the left end *2b* of the throttle shaft 2. Consequently, the amount of rotation of the throttle shaft 2, i.e. the opening of the throttle valve 3 (control valve) is detected by the throttle opening detector 71.

An accelerator drum shaft 22 is axially supported on the throttle body 9 with its axis parallel to the axis of the throttle shaft 2. An accelerator drum 24, which is linked to the operation of the accelerator pedal (not shown in the figure), and which is urged in a direction of non-operation of the accelerator pedal by a spring 28, is mounted on the accelerator drum shaft 22 so as to be pivotal thereabout and so as to turn an accelerator lever 25 (to be described hereafter) about the accelerator drum shaft 22. The accelerator lever 25 is fixedly attached to the accelerator drum shaft 22 and is provided with a first engagement pin 27 protruding therefrom at a distance from and pivotal about the accelerator drum shaft 22.

A stopper 85 is provided on the accelerator drum 24 for contacting with the accelerator drum 24 when it turns through a pre-determined angle in the direction of non-operation of the accelerator pedal under the urging of the spring 28, and for enabling adjustment of the angular position of the accelerator drum 24.

The accelerator drum 24 is engaged with a link 32 of a link mechanism generally indicated by arrow 31 which is connected to an accelerator drum opening detector 74 (opening detector) attached to the throttle body 9. The link mechanism 31 in combination with a link 33 transmits a rotation of the accelerator drum 24 to the accelerator drum opening detector 74. Hence, the amount of rotation of the accelerator drum 24 (i.e. the amount of pedal operation by the driver) is detected by the accelerator drum opening detector 74.

An actuator in the form of a step motor 41 is supported on the throttle body 9, with an axis of its output shaft 42 parallel to the throttle shaft 2. A drive lever shaft 44 having an axis parallel to the axis of output shaft 42 (i.e. the throttle shaft 2), and to which a drive lever 45 is fixedly attached is axially supported on the throttle body 9. A second engagement pin 47 is provided on the drive lever 45 so as to protrude therefrom at a distance from and be pivotal about the drive lever shaft 44. A follower gear 48 is provided on an outer peripheral face of the drive lever 45 so as to engage with a drive gear 43 which is fixedly attached to the output shaft 42 of the step motor 41. The drive lever 45 thus provides a pivotal linkage with the step motor 41.

Maximum and minimum angle adjustment screws 81 and 82, which can be adjusted to set the pivotal range of the drive lever 45, are provided on an opposite side of the drive lever 45 to that of the follower gear 48.

A link lever 51 is disposed between the right end *2a* of the throttle shaft 2 and the drive lever 45, and is provided with a first hole 52 for engagement with the first engagement pin 27 by way of a bearing member, a second elongated hole 54 for engagement with the second engagement pin 47 by way of a bearing member, and a third elongated hole 56 for engagement with the third engagement pin 7 by way of a bearing member. The first engagement pin 27 is engaged with the first hole 52, while the second and third engagement pins 47 and 7 are engaged with the respective second and third elongated holes 54 and 56 so as to be movable therein. Consequently, the accelerator lever 25, drive lever 45 and control valve shaft lever 5 are linked together by the link lever 51.

In the present embodiment, a coil spring 88 which urges the link lever 51 and the accelerator lever 25 in a constant direction, is disposed around the first engagement pin 27 so as to urge the link lever 51 in a constant direction relative to the accelerator lever 25.

With this arrangement, the first engagement pin 27, second engagement pin 47 and third engagement pin 7 function in effect as first, second and third engagement members.

The operation will now be described with reference to the figures. In FIGS. 5 to 11, to avoid confusion, only components such as the throttle valve 3, accelerator drum 24, accelerator lever 25, drive lever 45 and link lever 51 are shown, and the control valve shaft lever 5 is indicated by a chain double-dashed line.

Figure 5:
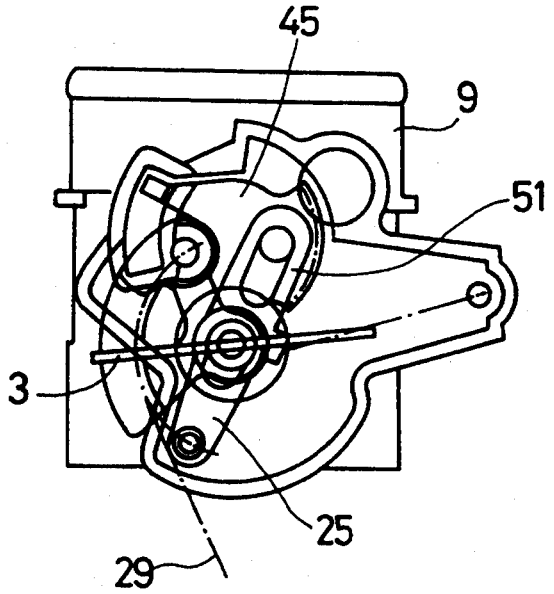
FIG. 5 is a sectional view of components illustrating an operation of the first embodiment.
Figure 6:
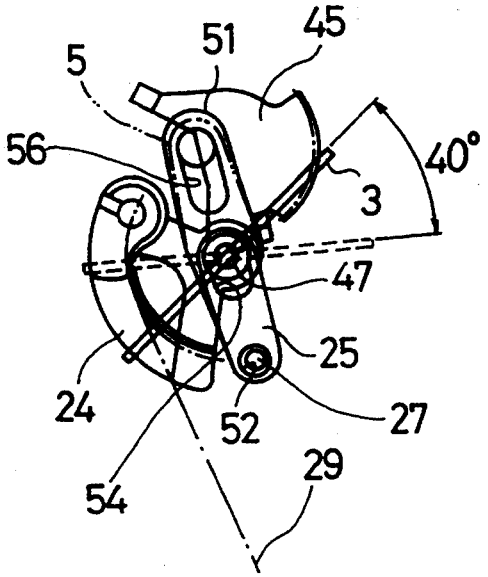
FIG. 6 is another sectional view of components illustrating an operation of the first embodiment.
Figure 7:
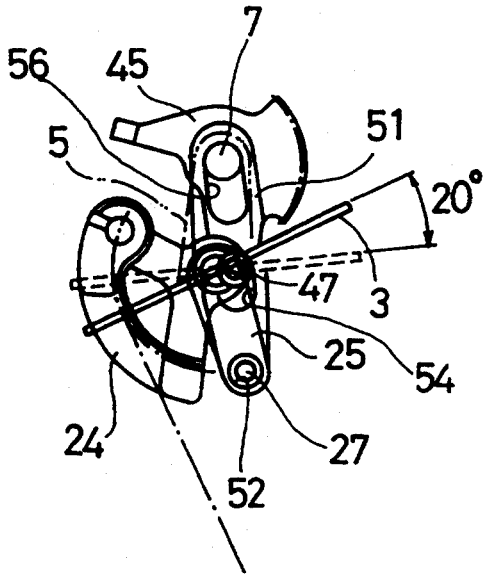
FIG. 7 is another sectional view of components illustrating an operation of the first embodiment.
Figure 8:
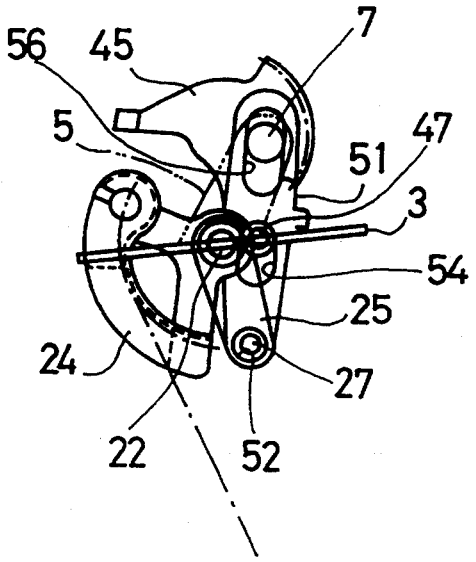
FIG. 8 is another sectional view of components illustrating an operation of the first embodiment.
Figure 9:
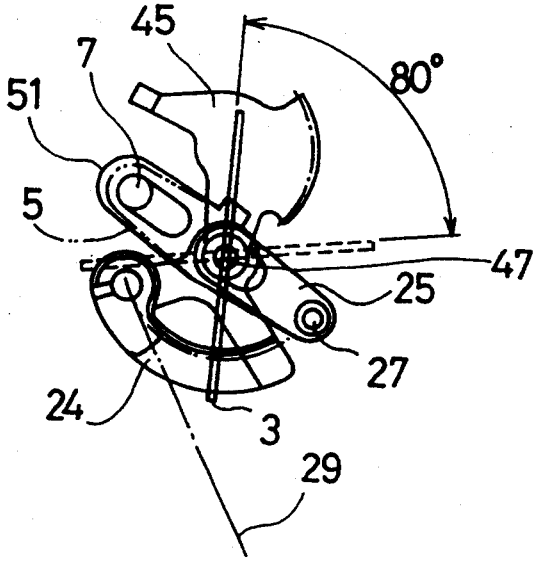
FIG. 9 is another sectional view of components illustrating an operation of the first embodiment.
Figure 10:
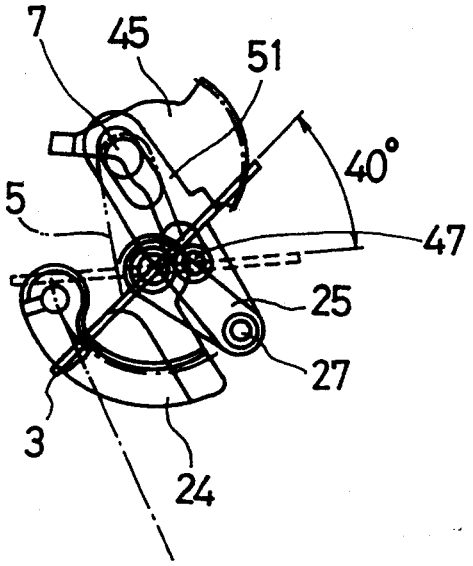
FIG. 10 is another sectional view of components illustrating an operation of the first embodiment.
Figure 11:
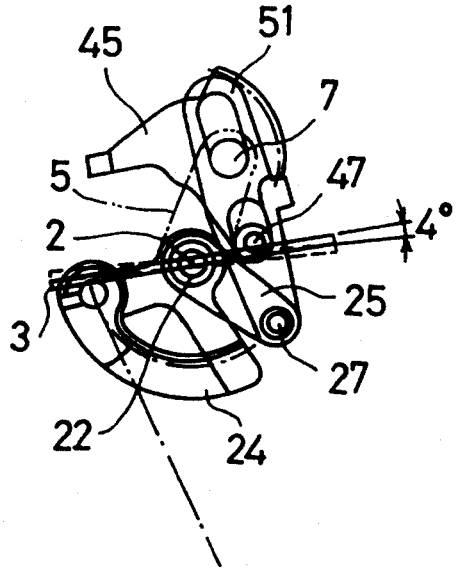
FIG. 11 is another sectional view of components illustrating an operation of the first embodiment.

FIG. 5 shows a condition wherein the accelerator pedal (which is not shown in the figure) is not pressed, and traction control is not operative. Pressing the accelerator pedal in this condition strokes the wire 29 wound on the accelerator drum 24, and as shown in FIG. 6 or FIG. 9, pivots the accelerator drum 24 counter clockwise through a pre-determined angle about the accelerator drum shaft 22.

Pivoting of the accelerator drum 24 through a predetermined angle about the accelerator drum shaft 22 pivots the accelerator lever 25 counter clockwise about the accelerator drum shaft 22.

Since the traction control is not operative, the step motor 41 does not turn, so that the drive lever 45 remains in a fixed condition. Consequently, the second engagement pin 47 engaged with the second elongated hole 54 of the link lever 51 also remains in a fixed condition.

Pivoting of the first engagement pin 27, which is engaged with the first hole 52, through a pre-determined angle in a counter clockwise direction, pivots the link lever 51 counter clockwise about the second engagement pin 47. The third engagement pin 7 is engaged with the third elongated hole 56 by way of a bearing member or bearing when the control valve shaft lever 5 on which the third engagement pin 7 is mounted pivots, the throttle shaft 2 which is fixedly attached to the control valve shaft lever 5 turns counter clockwise through a pre-determined angle.

That is to say, when the step motor 41 is stationary and the accelerator is operated, the link lever 51 pivots about the second engagement pin 47 to turn the throttle valve 3 in accordance with the operation of the accelerator.

In the present embodiment, the throttle shaft 2 and the accelerator drum shaft 22 both lie on the same axis. The throttle shaft 2 therefore rotates in a predetermined linear angular relationship with a pivotal rotation of the accelerator drum 24 so that the driver experiences no difference in feel.

Next is a description with reference to FIGS. 7, 8 and FIGS. 10, 11 of the situation wherein a slip condition of the vehicle is detected and a traction control request signal is issued to rotate the step motor 41.

With clockwise rotation of the step motor 41, since the drive gear 43 is meshed with the follower gear 48, the drive lever 45 is turned counter clockwise about the drive lever shaft 44 through a pre-determined angle, thereby pivoting the second engagement pin 47 counter clockwise about the drive lever shaft 44 through a predetermined angle.

When traction control is carried out with the accelerator pedal held pressed by a pre-determined amount (i.e. with the accelerator drum 24 in a fixed condition), the first engagement pin 27 engaged with the first hole 52 of the link lever 51 also remains in a fixed condition. Since the second elongated hole 54 is elongated, then even with the difference in pivot radius of the second pin 47 and second elongated hole 54, the difference is absorbed by the slot length of the elongated hole 54.

Consequently, counter clockwise pivoting of the second engagement pin 47 engaged with the second elongated hole 54 through a pre-determined angle results in the link lever 51 pivoting in a clockwise direction about the first engagement pin 27. In this case, since the third engagement pin 7 is engaged with the third elongated hole 56 of the link lever 51, the control valve shaft lever 5 on which the third engagement pin 7 is mounted pivots, thereby turning the throttle shaft 2 fixed to the control valve shaft lever 5 through a predetermined angle in a clockwise direction.

Hence, operation of the step motor 41 without operation of the accelerator results in the link lever 51 pivoting about the first engagement pin 27 to turn the throttle valve 3 in accordance with the operation of the step motor 41.

With the present embodiment as described above, the third engagement pin 7 is engaged with the third elongated hole 56 so as to be movable therein, the second engagement pin 47 is engaged with the second elongated hole 54 so as to be movable therein, and the first engagement pin 27 is engaged with the first hole 52. Consequently, the accelerator lever 25, drive lever 45 and control valve shaft lever 5 are linked together by the link lever 51. Thus, by having the second engagement pin 47 as an input end and the first engagement pin 27 as a pivot point, or the first engagement pin 27 as an input end and the second engagement pin 47 as a pivot point, the third engagement pin 7 acts as an output end for both cases and can be pivoted in opposite directions. In other words, linking each of the levers together with the link lever 51 enables pivotal motion in opposite directions. Hence, a control valve control apparatus having few components, a simplified mechanism and high reliability is possible for carrying out control operations such as traction control.

With the present invention, the maximum angle adjustment screw 81 and minimum angle adjustment screw 82 are provided.

The maximum angle adjustment screw 81 sets the maximum pivotal angle of the drive lever 45 when pivoted in a counter clockwise direction (as shown in FIG. 1) by the step motor 41. If the drive lever 45 is pivoted by the step motor 41 through an angle greater than a predetermined angle in a counter clockwise direction, then even with pivoting of the accelerator lever 25 due to an operation of the accelerator to close the throttle valve 3, the throttle valve 3 may not be closed completely due to the large displacement of the second engagement pin 47 which acts as the pivot point. Since with the present embodiment, the position of the second engagement pin 47 is set within a predetermined range by the maximum angle adjustment screw 81, the opening of throttle valve 3 is restrained below a predetermined opening by the maximum angle adjustment screw 81 so as to provide a fail-safe insurance against failure, such as of the step motor 41.

Furthermore, the minimum angle adjustment screw 82 sets the maximum pivotal angle of the drive lever 45 when pivoted in a clockwise direction (as shown in FIG. 1) by the step motor 41. If the drive lever 45 is pivoted by the step motor 41 through an angle greater than a predetermined angle in a clockwise direction, then even with pivoting of the accelerator lever 25 due to an operation of the accelerator to open the throttle valve 3, the throttle valve 3 may hardly open due to the large displacement of the second engagement pin 47 which acts as the pivot point. Since with the present embodiment, the position of the second engagement pin 47 is set within a predetermined range by the minimum angle adjustment screw 82, the opening of throttle valve 3 may be set above a predetermined opening by the minimum angle adjustment screw 82. Hence even with failure, such as of the step motor 41, a minimum limit of opening of the throttle valve 3 under accelerator operation is possible so as to ensure a "limp home" function.

The maximum angle adjustment screw 81 and minimum angle adjustment screw 82 thus function in effect as regulating means.

Since the stopper 85 is provided adjacent to the accelerator drum 24, then when the accelerator drum 24 is returned so as to close the throttle valve 3 under the urging force of the spring 28 on completion of the accelerator operation, it contacts with the stopper 85. Consequently, shock loading due to the urging force of the spring 28 is taken by the stopper 85 and is prevented from acting on the other components such as the link lever 51, so that the life of the link lever 51 and first engagement pin 27 etc. can be extended.

The link lever 51 is urged in a constant direction with respect to the accelerator lever 25 by the coil spring 88 provided on the first engagement pin 27. Hence, any slack in the engagement of the first engagement pin 27 in the first hole 52 and the movable engagement of the second engagement pin 47 and third engagement pin 7 in the respective second elongated hole 54 and third elongated hole 56 is absorbed by the respective pins being forced to one side of the respective holes.

Figure 12:
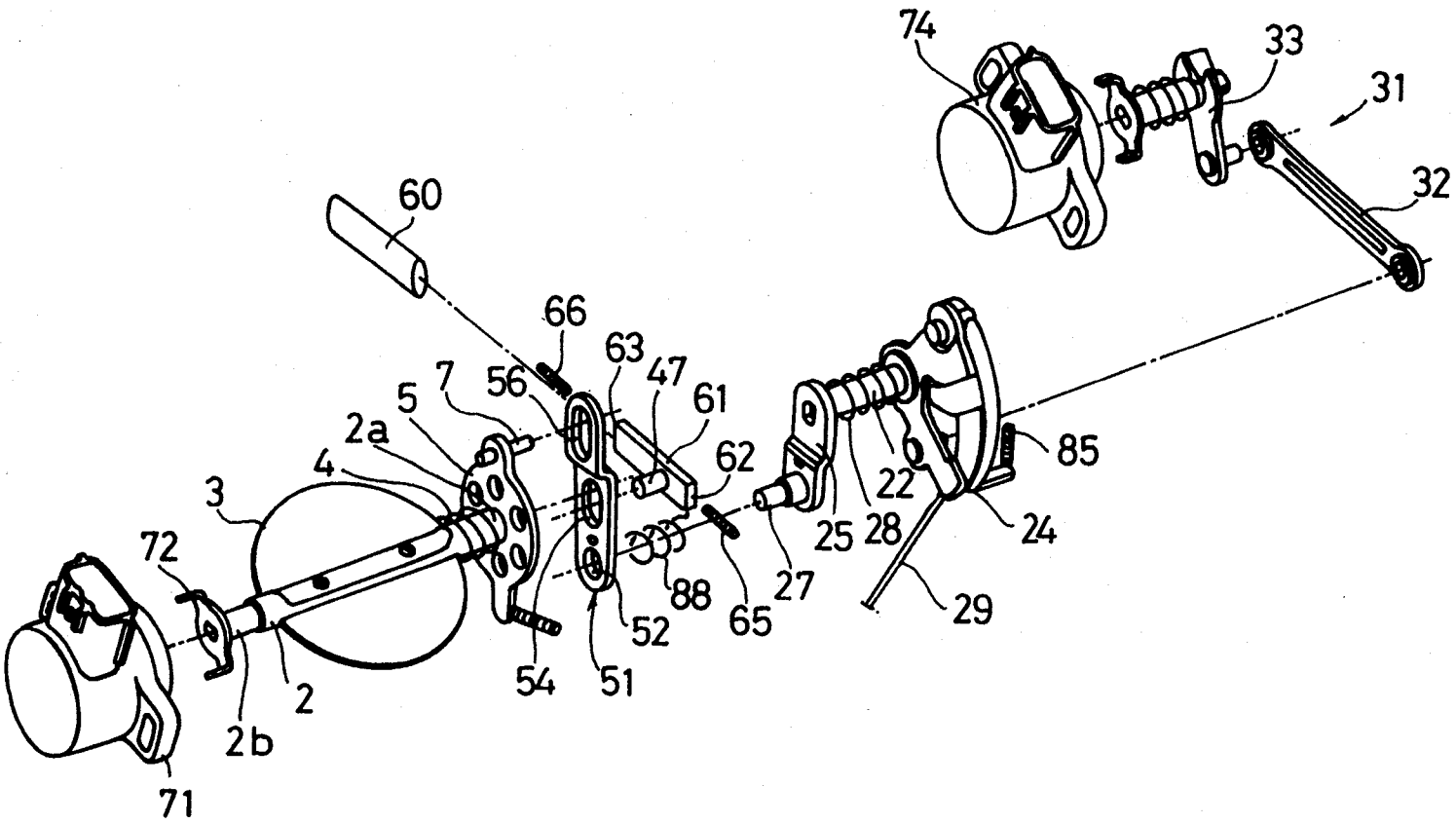
FIG. 12 is a schematic perspective view of a throttle valve control apparatus according to a second embodiment of the present invention.

Next is a description of a second embodiment of the present invention with reference to FIG. 12. Components similar to those of the first embodiment are indicated with the same symbols and the description is omitted.

In the second embodiment, a linear actuator 60 is supported on the throttle body 9 so that its direction of operation is approximately perpendicular to the pivotal axis of the accelerator drum shaft 22 and the longitudinal axis of the elongated hole 54, and the second engagement pin 47 is protrudingly provided on a drive lever 61 which is moved in the direction of operation by the linear actuator 60.

Maximum and minimum movement adjustment screws 65 and 66 are respectively provided to correspond with opposite ends 62 and 63 of the drive lever 61 so that the movement range of the drive lever 61 can be set by their adjustment.

With the second embodiment, when traction control is not being carried out the linear solenoid 60 does not operate. Consequently, the second engagement pin 47 engaged with the second elongated hole 54 of the link lever 51 also remains in a fixed condition. Thus, when the linear solenoid 60 does not operate, and the accelerator is operated, the link lever 51 pivots about the second engagement pin 47 to turn the throttle valve 3 in accordance with the operation of the accelerator.

Next is a description of the situation wherein a slip condition of the vehicle is detected and a traction control request signal is issued to operate the linear solenoid 60.

With movement of the linear solenoid 60 towards the maximum movement point adjustment screw 65, the second engagement pin 47 moves by only a predetermined amount in a counter clockwise direction about the third engagement pin 7.

This movement of the second engagement pin 47, which is engaged with the second elongated hole 54, through only a predetermined amount in a counter clockwise direction results in the link lever 51 being pivoted in a clockwise direction about the first engagement pin 27. In this case, since the third engagement pin 7 is engaged in the third elongated hole 56 of the link lever 51, the control valve shaft lever 5 to which the third engagement pin 7 is attached pivots so that the throttle shaft 2 which is fixed to the control valve shaft lever 5 is turned through a predetermined angle in a clockwise direction.

When the accelerator is not operated, the link lever 51 pivots about the first engagement pin 27 with movement of the linear solenoid 60 to turn the throttle valve 3 in accordance with the drive from the linear solenoid 60. Hence, operation and results similar to those of the first embodiment are also realized in the second embodiment.

With the embodiments described above, the first hole 52 and two elongated holes, namely the second elongated hole 54 and the third elongated hole 56 are formed in the link lever 51. However, a construction of a link mechanism involving the accelerator lever 25, drive lever 45, control valve shaft lever 5 and link lever 51 is possible provided that at least two of the holes for engaging with the first, second and third engagement pins 27, 47 and 7 in that order are elongated.

Furthermore, a construction of a link mechanism involving the accelerator lever 25, drive lever 45, control valve shaft lever 5 and link lever 51 is possible without the requirement for the first hole 52, second elongated hole 54, and third elongated hole 56 to be formed in that order.

INDUSTRIAL APPLICABILITY

With the control valve control apparatus according to the present invention as described above, the control valve can be turned through operation of the accelerator alone or through operation of the actuator. Consequently, the number of components for the control valve control apparatus can be reduced, the mechanism simplified and the cost lowered. Moreover, with a reduction in the number of components, component adjustment becomes simpler, and reliability of the apparatus is improved. Consequently, the apparatus is suitable for use in the control of automotive engine fuel supply systems, and in controls wherein flow rate is changed through control of the opening of a control valve.

I claim:

1. A control valve opening control apparatus comprising;

a pivotally mounted accelerator lever linked to an accelerator operation and having a first engagement member disposed thereon at a distance from a pivotal axis of its pivotal mount, a drive lever linked to an actuator and having a second engagement member, a pivotally mounted control valve shaft lever assembled integral with a control valve and having a third engagement member disposed thereon at a distance from a pivotal axis of its pivotal mount, a link lever having engagement portions for engagement with said first, second and third engagement members such that any one of distances between said first and second engagement members, between said first and third engagement members, and between said second and third engagement members is variable, for linking together said accelerator lever, drive lever and control valve shaft lever, and a spring interposed between said link lever and said accelerator lever so as to urge said link lever in a constant direction relative to said accelerator lever.

2. A control valve opening control apparatus as claimed in claim 1, constructed such that in a condition where said actuator is stationary, when said link lever is pivoted about said second engagement member and said accelerator lever is pivoted by said accelerator operation, pivotal rotation of said accelerator lever is transmitted to said control valve by way of said first engagement member provided on said accelerator lever, said link lever, and said third engagement member provided on said control valve shaft lever, thereby turning said control valve.

3. A control valve opening control apparatus as claimed in claim 1, wherein when said actuator is operated with said accelerator operation fixed, said link lever is pivoted about said first engagement member by way of said second engagement member linked to said actuator, thereby turning said control valve by way of said third engagement member.

4. A control valve opening control apparatus as claimed in claim 3, further comprising a regulator means, attached to said drive lever, for regulating said control valve opening below a predetermined opening, and ensuring a minimum control valve opening when said actuator is operated and said accelerator operation is fixed at a lower limit position.

5. A control valve opening control apparatus as claimed in claim 4, wherein said regulator means comprises an adjustment screw which regulates a linkage of said drive lever from said actuator.

6. A control valve opening control apparatus as claimed in claim 3, wherein a step motor is used as said actuator with said drive lever having an axis parallel to said pivotal axis such that when said step motor turns, said link lever is pivoted about said first engagement member by pivotal rotation of said drive lever, thereby turning said control valve by way of said third engagement member.

7. A control valve opening control apparatus as claimed in claim 3, wherein a linear actuator having a direction of operation approximately perpendicular to said pivotal axis is used as an actuator such that when said linear actuator is operated, said link lever is pivoted about said first engagement member due to movement of said drive lever thereby turning said control valve by way of said third engagement member.

8. A control valve opening control apparatus as claimed in claim 1, wherein said first, second and third engagement members comprise respective first, second and third engagement pins respectively disposed on said accelerator lever, drive lever, and control valve shaft lever.

9. A control valve opening control apparatus as claimed in claim 1, wherein at least two of said engagement portions provided on said link lever comprise elongated holes for engaging with at least two of said first, second or third engagement members.

10. A control valve opening control apparatus as claimed in claim 1, wherein the engagement portion for engaging with said second engagement member is disposed between the engagement portion for engaging with said first engagement member and the engagement portion for engaging with said third engagement member.

11. A control valve opening control apparatus as claimed in claim 1, wherein the pivotal axis of said accelerator lever and the axis of said control valve shaft assembled integral with said control valve are located on the same axis.

12. A control valve opening control apparatus as claimed in claim 1, utilized for controlling throttle opening of an automotive engine fuel supply system.

* * * * *